US012195143B1

(12) United States Patent
Khachaturian

(10) Patent No.: US 12,195,143 B1
(45) **Date of Patent: *Jan. 14, 2025**

(54) METHOD AND APPARATUS FOR UNLOADING CARGO IN AN OFFSHORE MARINE ENVIRONMENT

(71) Applicant: Jon Khachaturian, New Orleans, LA (US)

(72) Inventor: Jon Khachaturian, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/521,247

(22) Filed: Nov. 28, 2023

Related U.S. Application Data

(63) Continuation of application No. 17/965,119, filed on Oct. 13, 2022, now Pat. No. 11,866,131, which is a continuation of application No. 17/003,152, filed on Aug. 26, 2020, now Pat. No. 11,492,080.

(60) Provisional application No. 62/891,724, filed on Aug. 26, 2019.

(51) Int. Cl.

| | |
|---|---|
| ***B63B 27/36*** | (2006.01) |
| ***B63B 25/02*** | (2006.01) |
| ***B63B 25/08*** | (2006.01) |
| ***B63B 27/00*** | (2006.01) |

(52) U.S. Cl.
CPC ..... *B63B 25/08* (2013.01); *B63B 27/19* (2020.05); *B63B 27/36* (2013.01); *B63B 2025/025* (2013.01)

(58) Field of Classification Search
CPC ..... B63B 27/00; B63B 27/19; B63B 27/30; B63B 27/36; B63B 25/00; B63B 25/08; B63B 2025/025
USPC ..... 114/61.1, 72, 74 R
See application file for complete search history.

(56) References Cited

U.S. PATENT DOCUMENTS

| | | | | |
|---|---|---|---|---|
| 3,494,318 A * | 2/1970 | Ginjuro | B63B 35/68 | 114/248 |
| 3,698,349 A * | 10/1972 | Stevens | B63B 35/70 | 114/248 |
| 4,286,537 A * | 9/1981 | Hvide | B63B 35/70 | 114/248 |

* cited by examiner

*Primary Examiner* — Daniel V Venne
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A method of unloading cargo at sea from a cargo vessel to a cargo barge, comprising the steps of providing a catamaran vessel having a pair of spaced apart catamaran hulls and a pair of spaced apart arch shaped frames, each frame attached to each hull at a frame lower end portion; positioning the cargo vessel in between the hulls and under the top portion of the frames; placing one or more cargo barges next to one or both of the hulls, wherein the hull is in between the cargo vessel and the cargo barge; and unloading cargo from the cargo vessel to the cargo barge wherein the cargo travels from the cargo vessel, over the catamaran hull to the cargo barge.

18 Claims, 5 Drawing Sheets

METHOD AND APPARATUS FOR UNLOADING CARGO IN AN OFFSHORE MARINE ENVIRONMENT

CROSS-REFERENCE TO RELATED APPLICATIONS

This application claims benefit of U.S. Provisional Patent Application Ser. No. 62/891,724, filed 26 Aug. 2019, which is hereby incorporated herein by reference.

Priority of U.S. Provisional Patent Application Ser. No. 62/891,724, filed 26 Aug. 2019, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that provides a portable "mini-port" that can unload cargo in an offshore marine environment when access to an established port (e.g., land based) is restricted due to an accident or build up of sediment (e.g., silt or sand or other) that has reduced available draft.

2. General Background of the Invention

At times access to an established port is restricted because of natural causes that reduce available draft. For example, the Mississippi River silted up this year and several ships were sitting too low when they showed up at the mouth of the river. They were unloaded offshore at anchor with an available crane vessel, but this procedure took weeks and generated significant costs.

Further, some ships come into the Gulf of Mexico "light" because they cannot enter New Orleans or Houston with a full load. If these large cargo vessels could be unloaded offshore safely and quickly, there would be a huge cost savings.

The cargo of these ships could be liquid (oil, glycol, etc.), bulk (bauxite, limestone, other ores, etc.) or even containers.

One possible solution is to provide a catamaran type vessel that could move over a ship in transit (at a speed of, for example, 3-5 knots) and unload the subject vessel without the need to stop and anchor. Stopping and anchoring wastes time. The apparatus of the present invention is extremely stable with minimal roll motions and could provide an American Bureau of Shipping (ABS) dynamic positioning 3 system that would sync its speed to execute the operation safely.

Several patents have issued that are directed to a catamaran vessel fitted with spaced apart arch shaped frames. For example, U.S. Pat. Nos. 7,527,006; 7,886,676; 8,061,289; 8,240,264; 8,985,040; 9,527,560; 9,604,710; 9,926,042; 10,173,758 are issued to Jon Khachaturian and each of which is hereby incorporated herein by reference.

BRIEF SUMMARY OF THE INVENTION

The method of the present invention provides an attachment of two cargo barges to the catamaran vessel creating a temporary "quad-maran" for effecting cargo transfer. The cargo barges can be "quick-released" (minutes) after loading, and sent to a desired location.

The connections can be pin-in-pin and wide-side connections. Such pin-in-pin and wide side (pivotal or hinge) connections can be seen in the above listed patents that are incorporated herein by reference. For example, see FIGS. 4, 9A-9D and 11 of U.S. Pat. No. 8,061,289 and related text. The catamaran vessel existing connections are preferably used at one end of each connecting or lock down boom, and preferably incorporate similar but opposite connections at the tip of each connecting boom, and preferably maneuver to lock onto the cargo barges.

The unique nature and arrangement of these pinned connections allow this flotilla of barges to "flex" with the seas; but the rigidity of the booms allows total control of vessel spacing for the duration of the cargo transfer operation.

This method and apparatus of the present invention eliminates the need for third or fourth self-propelled vessels to be involved in the operation and can be set up and ready before the large cargo ship arrives. Different cargo barges can be interchanged and used to transfer different types of cargo.

The present invention includes a method of unloading cargo at sea from a cargo vessel to a cargo barge. The method includes a catamaran vessel having a pair of spaced apart catamaran hulls and a pair of spaced apart arch shaped frames, each frame preferably attaches to each hull at a frame lower end portion. The cargo vessel is preferably positioned in between the hulls and under the top portion of the frames. One or more cargo barges can be placed next to one or both of the hulls, wherein the hull is preferably in between the cargo vessel and the cargo barge. Cargo can be unloaded from the cargo vessel to the cargo barge wherein the cargo travels from the cargo vessel, over the catamaran hull to the cargo barge.

In one embodiment, one or more hoses or pipes can extend between the cargo vessel and the cargo barge.

In one embodiment, the cargo can be a liquid cargo.

In one embodiment, the cargo can be a slurried cargo.

In one embodiment, the cargo can be a bulk or solid cargo.

In one embodiment, the cargo can be one or more shipping containers.

In one embodiment, the cargo barge can be attached to the catamaran hull.

In one embodiment, the cargo barge is preferably connected to the catamaran hull with a quick release connection.

In one embodiment, the cargo barge is preferably attached to the catamaran barge with one or more booms.

The present invention includes a method of unloading cargo at sea from a cargo vessel to a cargo barge. The method includes providing a catamaran vessel preferably having a pair of spaced apart catamaran hulls and a pair of spaced apart frames, each frame attached to each hull. The cargo barge can be placed next to one of the hulls, wherein the hull is preferably in between the cargo vessel and the cargo barge. The cargo vessel can be positioned in between the hulls and under the frames. The cargo vessel and the catamaran hulls can be moved at a selected speed. Cargo can be unloaded from the cargo vessel to the cargo barge wherein the cargo preferably travels from the cargo vessel, over the catamaran hull to the cargo barge.

In one embodiment, there are preferably two cargo barges, each cargo barge preferably connected to a different one of the catamaran hulls.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
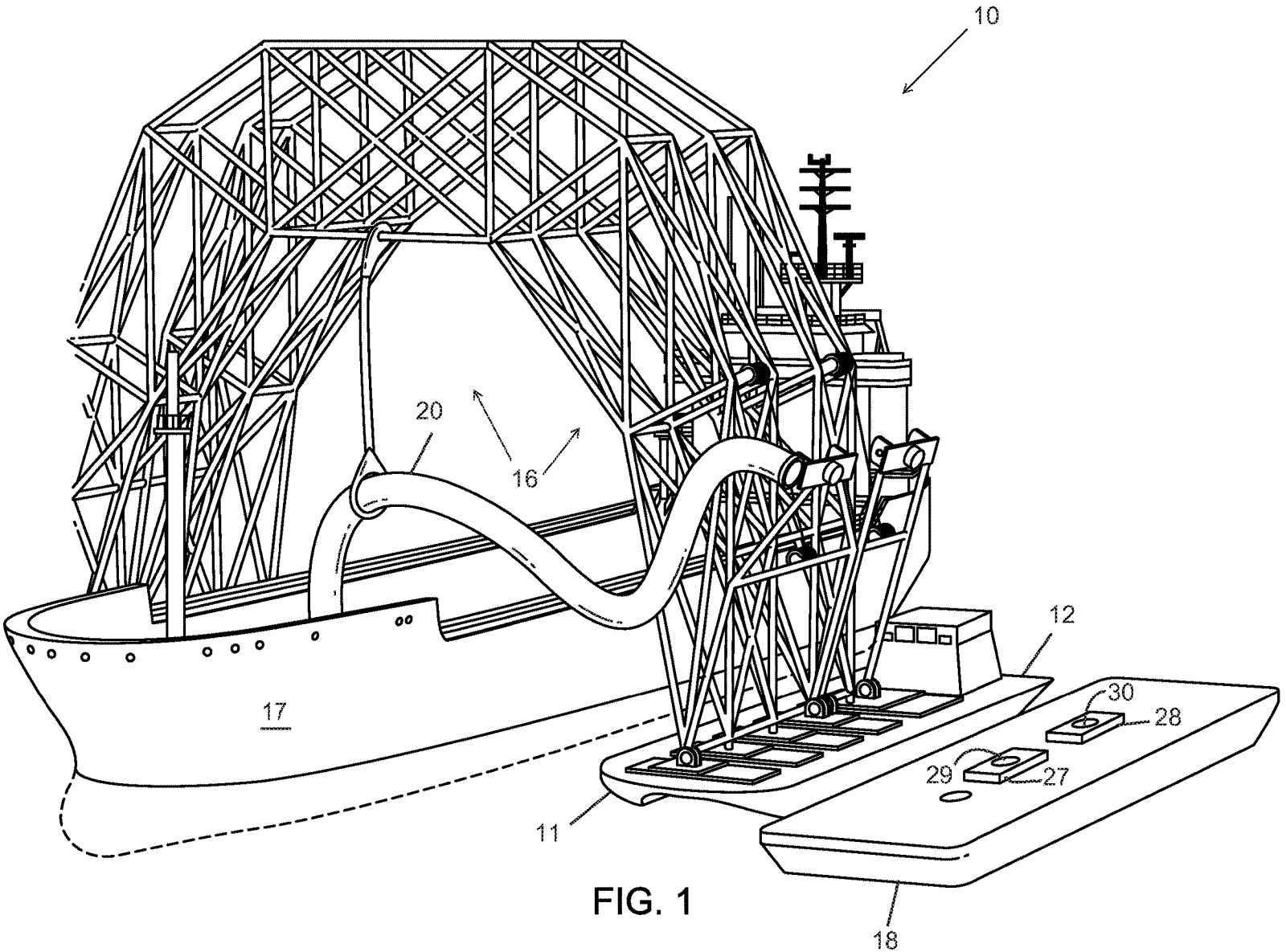
FIG. 1 is a perspective view showing a method and apparatus of the present invention.

FIGS. 1-5 show a preferred embodiment of the present invention, designated generally by the numeral 10. The method and apparatus of the present invention provides catamaran vessel 11 which can be as seen in U.S. Pat. No. 7,527,006 which is hereby incorporated herein by reference.

Vessel 11 provides two spaced apart hulls 12, 13. Two arch shaped frames or trusses 14, 15 are spaced apart. Each frame 14, 15 attaches at frame end portions to hulls 12, 13 as shown and described in U.S. Pat. No. 7,527,006 and the other above listed patents that are hereby incorporated herein by reference.

Figure 2:
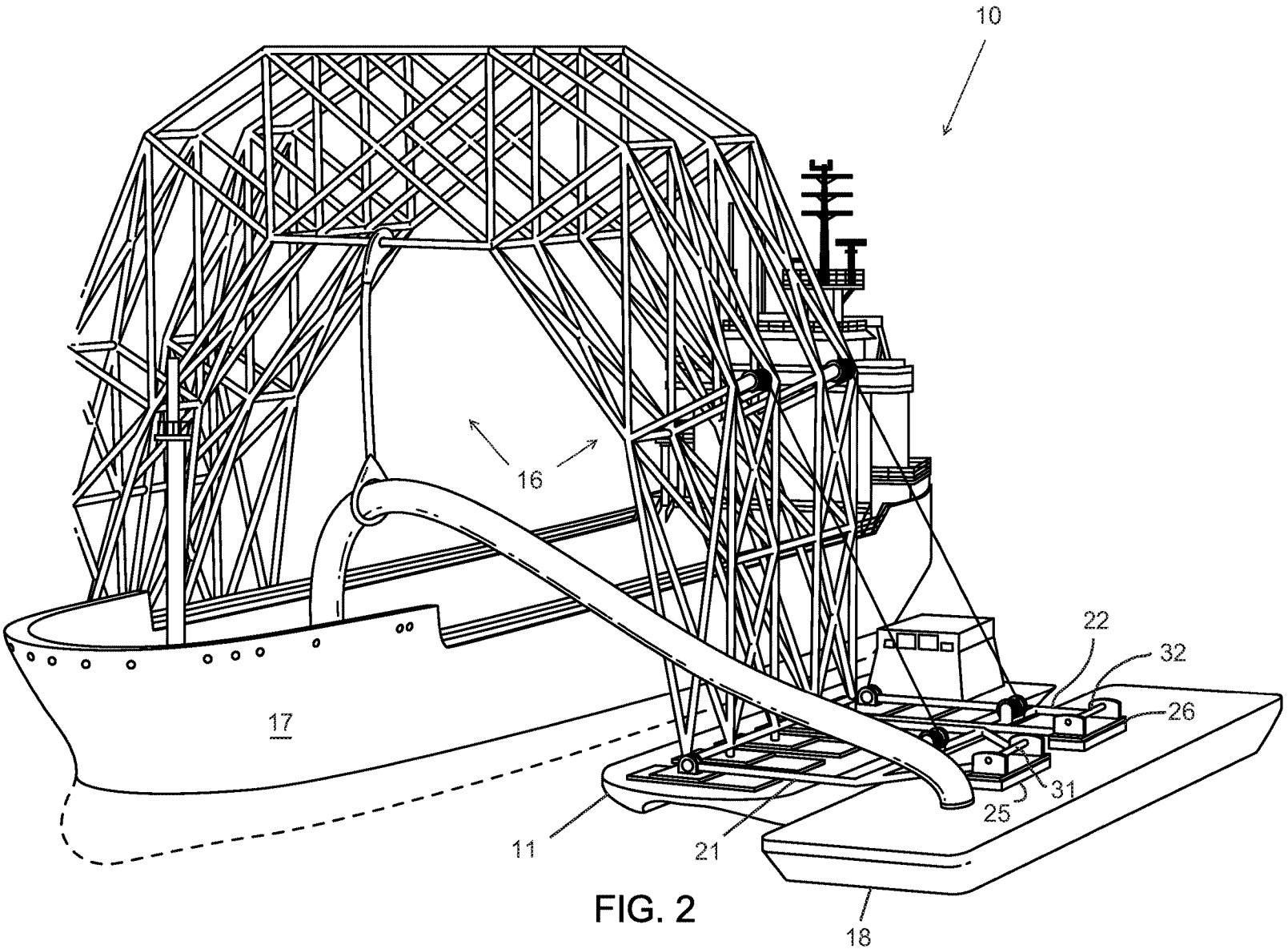
FIG. 2 is a perspective view showing a method and apparatus of the present invention.
Figure 3:
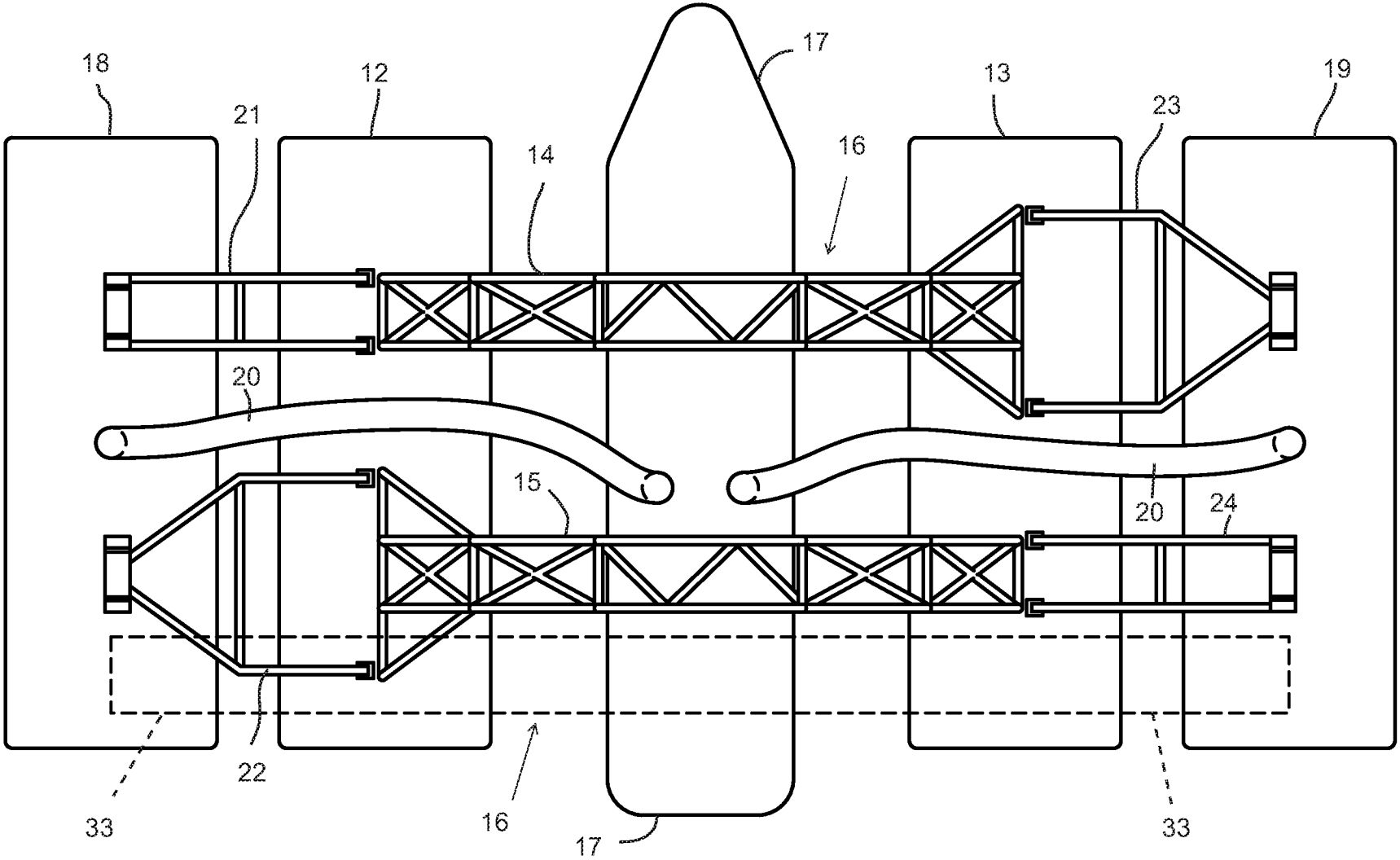
FIG. 3 is a plan view showing a method and apparatus of the present invention.

A space 16 is thus provided under the frames 14, 15 and in between the hulls 12, 13 as seen in FIGS. 1-3. In FIGS. 1-2, the space 16 is occupied by large cargo vessel 17.

Cargo barges 18, 19 are preferably attached to the hulls 12, 13. Cargo barge 18 preferably attaches to hull 12. Cargo barge 19 preferably attaches to hull 13. The drawings figures also show a hose connection (or hard piping, if desired) for unloading liquid cargo using the quad-maran configuration of the present invention. However, the quad-maran can be accessorized with clam shell buckets and hoist means (e.g., crane) to unload bulk cargo or containers (e.g., see FIGS. 3-4). A hose or pipe 20 can be used to transfer a liquid cargo from cargo vessel 17 to a selected cargo barge 18 or 19. Booms or lock down booms 21, 22 or 23, 24 are attached to a selected hull 12 or 13. Each boom 21, 22 or 23, 24 can be attached (e.g., pivotally attached) to a selected cargo barge 18 or 19. In FIG. 1, the booms 21, 22 are not connected to a cargo barge 18, 19. In FIG. 2, each boom 21, 22 has pivoted to a generally horizontal position and is connected to barge 18. Similar connections of booms 23, 24 can be made to a cargo barge 19 on the starboard side of cargo vessel 17 (see FIGS. 3-5).

Connections 25, 26 are preferably provided on cargo barge 18. Connection 25 can be a universal joint connection. Connection 26 can be a pivotal or hinge connection.

Figure 4:
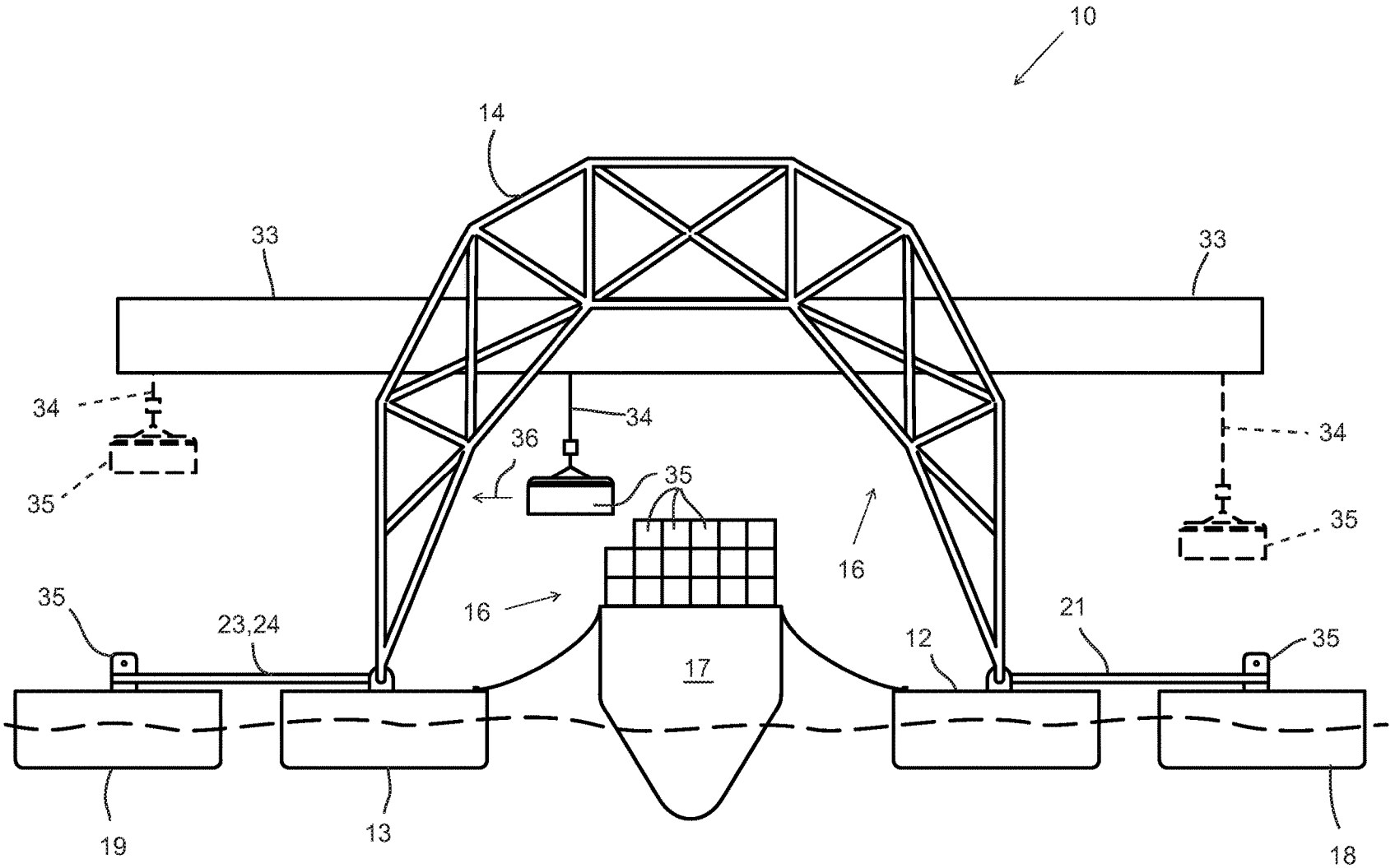
FIG. 4 is an elevation view showing a method and apparatus of the present invention.
Figure 5:
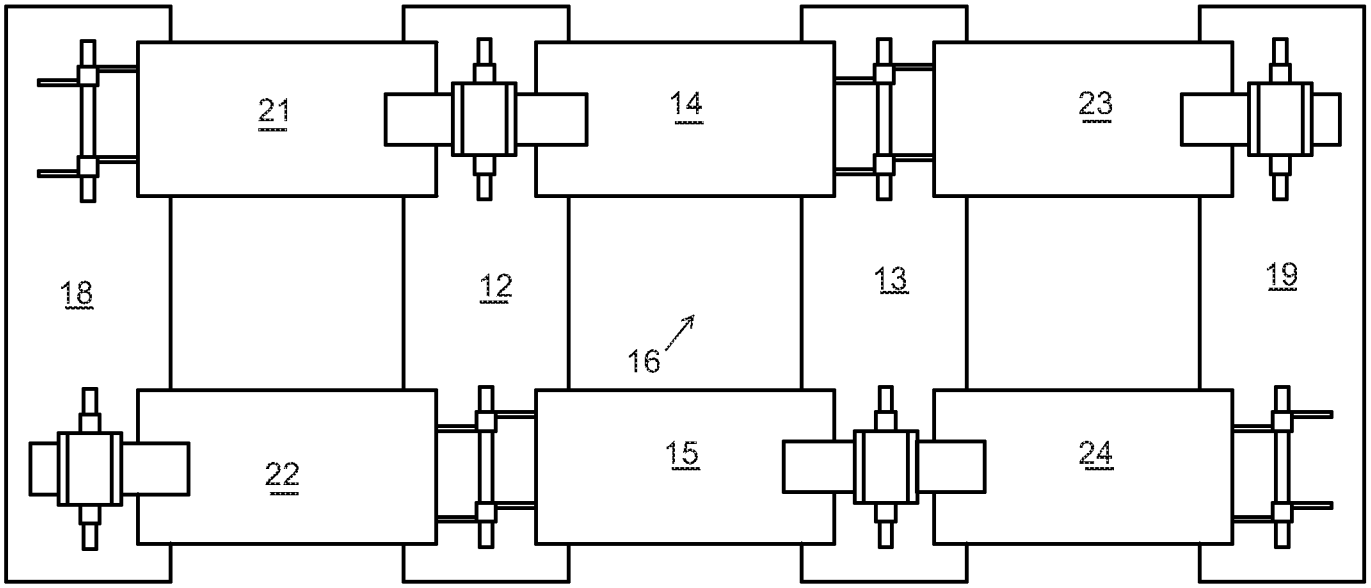
FIG. 5 is a partial plan view showing a method and apparatus of the present invention.

In FIGS. 3-5, lock down boom 21 can attach to hull 12 preferably using a pin-in-pin connection or universal joint. Boom 22 can connect to hull 12 preferably using a pivotal (wide side) connection. Boom 21 connects to cargo barge 18 preferably at a pinned or pivotal connection. Boom 22 connects to cargo barge 18 preferably with a pin-in-pin connection or universal joint. Booms 21, 22 each have a boom free end that is preferably in the form of a pin-in-pin (end portion 31 of boom 21) or hinge/pivot/wide side (end portion 32 of boom 22) connector. Each boom end portion 31, 32 preferably has a stab fitting (e.g., conical projection) that connects with an opening 29 or 30 of a structural box 27 or 28. The boxes 27, 28 can be of welded steel construction, reinforced with beams, gusset plates or plates and mounted (welded) to the deck of each cargo barge 18, 19.

Booms 23, 24 preferably span between and connect, in similar fashion to hull 13 and cargo barge 19 (e.g., see FIGS. 3-5).

FIGS. 3-4 show that dry cargo such as containers can be unloaded using overhead crane 33. Crane 33 can be structurally attached to a selected frame 14 or 15. The overhead crane has a powered (e.g., winch) lifting line 34 that can lift and transport laterally (e.g., see arrows 36) a container 35. The container or other cargo item or package 35 can then be lowered to a selected cargo barge 18 or 19 as shown.

The following is a list of parts and materials suitable for use in the present invention:

PARTS LIST

Part Number Description

10 cargo unloading system
11 catamaran vessel
12 first hull
13 second hull
14 first frame
15 second frame
16 space
17 large cargo vessel
18 cargo barge
19 cargo barge
20 hose/pipe
21 boom
22 boom
23 boom
24 boom
25 connection
26 connection
27 structural box
28 structural box
29 stab fitting opening
30 stab fitting opening
31 boom 21 free end
32 boom 22 free end
33 overhead crane
34 lift line/powered lift line
35 container/cargo
36 arrow All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of unloading cargo at sea from a cargo vessel to a cargo barge, comprising the steps of:

a) providing a catamaran vessel having a pair of spaced apart catamaran hulls and a pair of spaced apart arch shaped frames, each of said arch shaped frames attached to each of said catamaran hulls at a frame lower end portion;

b) positioning the cargo vessel in between the pair of catamaran hulls;

c) placing one or more cargo barges next to one or both of the catamaran hulls, wherein one of the catamaran hulls is in between the cargo vessel and the one or more cargo barges; and d) unloading cargo from the cargo vessel to the cargo barge wherein the cargo travels from the cargo vessel, over one of the catamaran hulls to the cargo barge.

2. The method of claim 1 further comprising one or more hoses or pipes that extend between the cargo vessel and the cargo barge.

3. The method of claim 2 wherein the cargo is a liquid cargo.

4. The method of claim 2 wherein the cargo is a slurried cargo.

5. The method of claim 1 wherein step "d" the cargo is a bulk or solid cargo.

6. The method of claim 1 wherein the cargo is one or more shipping containers.

7. The method of claim 1 further comprising attaching the cargo barge to one of the catamaran hulls.

8. The method of claim 7 wherein the cargo barge is connected to one of the catamaran hulls with a quick release connection.

9. The method of claim 7 wherein the cargo barge is attached to one of the catamaran hulls with one or more booms.

10. A method of unloading cargo at sea from a cargo vessel to a cargo barge, comprising the steps of:

a) providing a catamaran vessel having a pair of spaced apart catamaran hulls and a pair of spaced apart frames, each of said frames attached to each of said catamaran hulls;

b) placing the cargo barge next to one of the catamaran hulls, wherein the catamaran hull is in between the cargo vessel and the cargo barge;

c) positioning the cargo vessel in between the catamaran hulls and under the pair of frames;

d) moving the cargo vessel and the catamaran hulls at a selected speed; and e) unloading cargo from the cargo vessel to the cargo barge wherein the cargo travels from the cargo vessel, over one of the catamaran hulls to the cargo barge.

11. The method of claim 10 further comprising one or more hoses or pipes that extend between the cargo vessel and the cargo barge.

12. The method of claim 10 wherein the cargo is a liquid cargo.

13. The method of claim 10 wherein the cargo is a slurried cargo.

14. The method of claim 10 wherein step "e" the cargo is a bulk or solid cargo.

15. The method of claim 10 wherein the cargo is one or more shipping containers.

16. The method of claim 10 wherein the cargo barge is connected to one of the catamaran hulls with a quick release connection.

17. The method of claim 10 wherein the cargo barge is attached to one of the catamaran hulls with one or more booms.

18. The method of claim 10 wherein there are two cargo barges, each cargo barge connected to a different one of the catamaran hulls.

* * * * *